US007762656B2

(12) United States Patent
Snyder

(10) Patent No.: US 7,762,656 B2
(45) Date of Patent: Jul. 27, 2010

(54) METHOD FOR PREVENTING NOZZLE CONTAMINATION DURING WARM-UP

(75) Inventor: Trevor James Snyder, Newberg, OR (US)

(73) Assignee: Xerox Corporation, Norwalk, CT (US)

( * ) Notice: Subject to any disclaimer, the term of this patent is extended or adjusted under 35 U.S.C. 154(b) by 301 days.

(21) Appl. No.: 12/055,992

(22) Filed: Mar. 26, 2008

(65) Prior Publication Data

US 2009/0244172 A1 Oct. 1, 2009

(51) Int. Cl.
*B41J 2/175* (2006.01)
*B41J 2/165* (2006.01)

(52) U.S. Cl. ..... 347/88; 347/35; 347/23; 347/33

(58) Field of Classification Search ..... 347/88, 347/26, 14, 60, 29, 30, 33, 23, 35
See application file for complete search history.

(56) References Cited

U.S. PATENT DOCUMENTS 4,422,080 A * 12/1983 Titcomb ..... 347/89
6,350,012 B1 2/2002 Sarkissian et al.
6,779,879 B2 * 8/2004 Zhan ..... 347/77
7,111,917 B2 9/2006 Hill et al.
7,121,658 B2 10/2006 Platt et al.
7,144,100 B2 12/2006 Hill et al.
7,188,941 B2 3/2007 Platt et al.
7,490,921 B2 * 2/2009 Hashi et al. ..... 347/29
2006/0209146 A1 9/2006 Reeves

* cited by examiner

*Primary Examiner*—Shih-wen Hsieh
(74) *Attorney, Agent, or Firm*—Maginot, Moore & Beck LLP

(57) ABSTRACT

A method of operating a print head comprises heating the print head from a first temperature below a melting temperature of the phase change ink to a second temperature above the melting temperature. The print head has a nozzle plate with plurality of nozzles for ejecting the phase change ink onto an ink receiver. A first pressure is applied to an interior of the print head as the temperature of the print head increases from the first temperature to the second temperature. The first pressure is configured to prevent phase change ink from entering into the print head through the nozzles of the print head. The first pressure is removed from the print head in response to the print head being at approximately the second temperature.

20 Claims, 7 Drawing Sheets

METHOD FOR PREVENTING NOZZLE CONTAMINATION DURING WARM-UP

TECHNICAL FIELD

This disclosure relates generally to phase change ink jet printers, and in particular, to a method of preventing nozzle contamination in order to maintain the stable operation of the print head assembly used in phase change ink jet printers.

BACKGROUND

Solid ink or phase change ink printers conventionally receive ink in a solid form, sometimes referred to as solid ink sticks. The solid ink sticks are typically inserted through an insertion opening of an ink loader for the printer, and are moved by a feed mechanism and/or gravity toward a heater plate. The heater plate melts the solid ink impinging on the plate into a liquid that is delivered to a printhead assembly for jetting onto a recording medium. The recording medium is typically paper or a liquid layer supported by an intermediate imaging member, such as a metal drum or belt.

A printhead assembly of a phase change ink printer typically includes one or more printheads each having a plurality of ink jets from which drops of melted solid ink are ejected towards the recording medium. The ink jets of a printhead receive the melted ink from an ink supply chamber, or manifold, in the printhead which, in turn, receives ink from a source, such as a melted ink reservoir or an ink cartridge. Each ink jet includes a channel having one end connected to the ink supply manifold. The other end of the ink channel has an orifice, or nozzle, for ejecting drops of ink. The nozzles of the ink jets may be formed in an aperture, or nozzle plate that has openings corresponding to the nozzles of the ink jets. During operation, drop ejecting signals activate actuators in the ink jets to expel drops of fluid from the ink jet nozzles onto the recording medium. By selectively activating the actuators of the ink jets to eject drops as the recording medium and/or printhead assembly are moved relative to each other, the deposited drops can be precisely patterned to form particular text and graphic images on the recording medium.

One difficulty faced by fluid ink jet systems is nozzle contamination resulting in partially or completely blocked ink jets. Nozzle contamination may be caused by dust, paper fibers, dried ink, etc. that accumulates on the nozzle plate of a print head. Tests have shown that a phase change ink jet printer may be at risk for nozzle contamination during warm-up of the printer from a powered down or standby state, to an operational state. For example, as the print head warms up, the solid ink that has solidified or frozen in the print head melts and expands in the print head, causing melted ink to drool out of the nozzles onto the nozzle plate. By the time the printer has warmed up sufficiently to perform printing operations, however, the ink that has drooled out of the nozzles onto the nozzle plate may be sucked back into the nozzles. The ink that is drawn back into the print head may potentially draw contamination from the nozzle plate into the nozzles.

SUMMARY

A method for preventing or reducing nozzle contamination during warm-up of the printer has been developed. In particular, the method comprises heating the print head from a first temperature below a melting temperature of the phase change ink to a second temperature above the melting temperature. The print head has a nozzle plate with plurality of nozzles for ejecting the phase change ink onto an ink receiver. A first pressure is applied to an interior of the print head as the temperature of the print head increases from the first temperature to the second temperature. The first pressure is configured to prevent phase change ink from entering into the print head through the nozzles of the print head. The first pressure is removed from the print head in response to the print head being at approximately the second temperature.

In another embodiment, a phase change ink imaging device is provided. The phase change ink imaging device includes a print head assembly having a nozzle plate with a plurality of nozzles for ejecting melted phase change ink onto an ink receiver. The device includes a print head heater configured to heat the print head from a first temperature below a melting temperature of the phase change ink to a second temperature above the melting temperature. A positive pressure source is configured to apply a positive pressure to an interior of the print head at a first pressure and at a second pressure. The first pressure is configured to prevent phase change ink at the nozzles and on the nozzle plate of the print head from entering the nozzles of the print head, and the second pressure is greater than the first pressure and corresponds to a purge pressure. This is intended to flush particles or debris down the face of the jetstack in order to mitigate any chance of nozzle contamination. A pressure controller is configured to activate the positive pressure source to apply the first pressure to the interior of the print head as the temperature of the print head increases from the first temperature to the second temperature and to deactivate the positive pressure source so that the first pressure is removed from the interior of the print head when the temperature of the print head reaches approximately the second temperature.

BRIEF DESCRIPTION OF THE DRAWINGS

The foregoing aspects and other features of a fluid transport apparatus and an ink imaging device incorporating a fluid transport apparatus are explained in the following description, taken in connection with the accompanying drawings, wherein.

DETAILED DESCRIPTION

Figure 1:
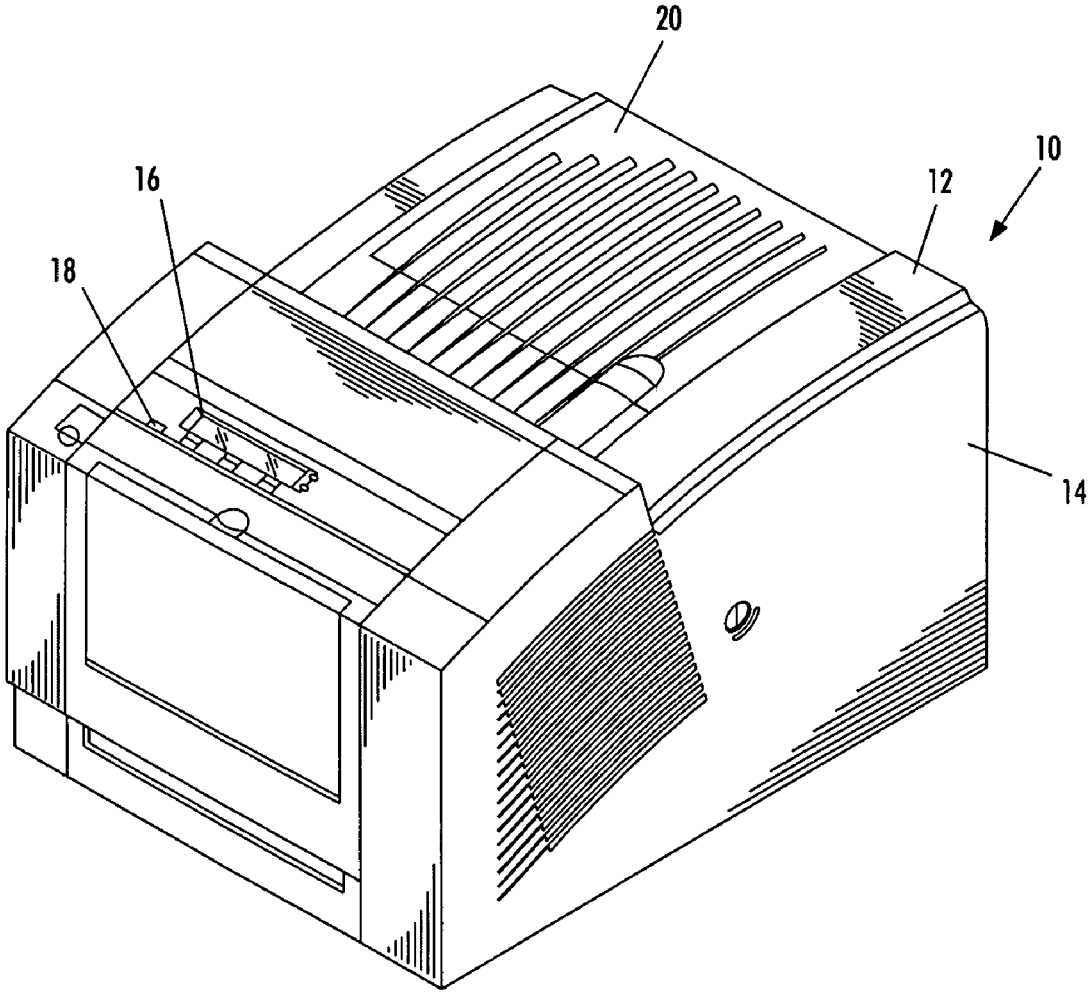
FIG. 1 PRIOR ART
FIG. 1 is a perspective view of a prior art phase change imaging device having a fluid transport apparatus described herein.

For a general understanding of the present embodiments, reference is made to the drawings. In the drawings, like reference numerals have been used throughout to designate like elements. Referring to FIG. 1, there is shown a perspective view of an ink printer 10 that implements a solid ink offset print process. The reader should understand that the embodiment discussed herein may be implemented in many alternate forms and variations and is not limited to solid ink printers only. The system and process described below may be used in image generating devices that operate components at different temperatures and positions to conserve the consumption of energy by the image generating device. Additionally, the principles embodied in the exemplary system and method described herein may be used in devices that generate images directly onto media sheets. In addition, any suitable size, shape or type of elements or materials may be used.

The ink printer 10 includes an outer housing having a top surface 12 and side surfaces 14. A user interface display, such as a front panel display screen 16, displays information concerning the status of the printer, and user instructions. Buttons 18 or other control mechanisms for controlling operation of the printer are adjacent the user interface window, or may be at other locations on the printer. An ink jet printing mechanism is contained inside the housing. The top surface of the housing includes a hinged ink access cover 20 that opens as shown in FIG. 2, to provide the user access to the ink feed system.

Figure 2:
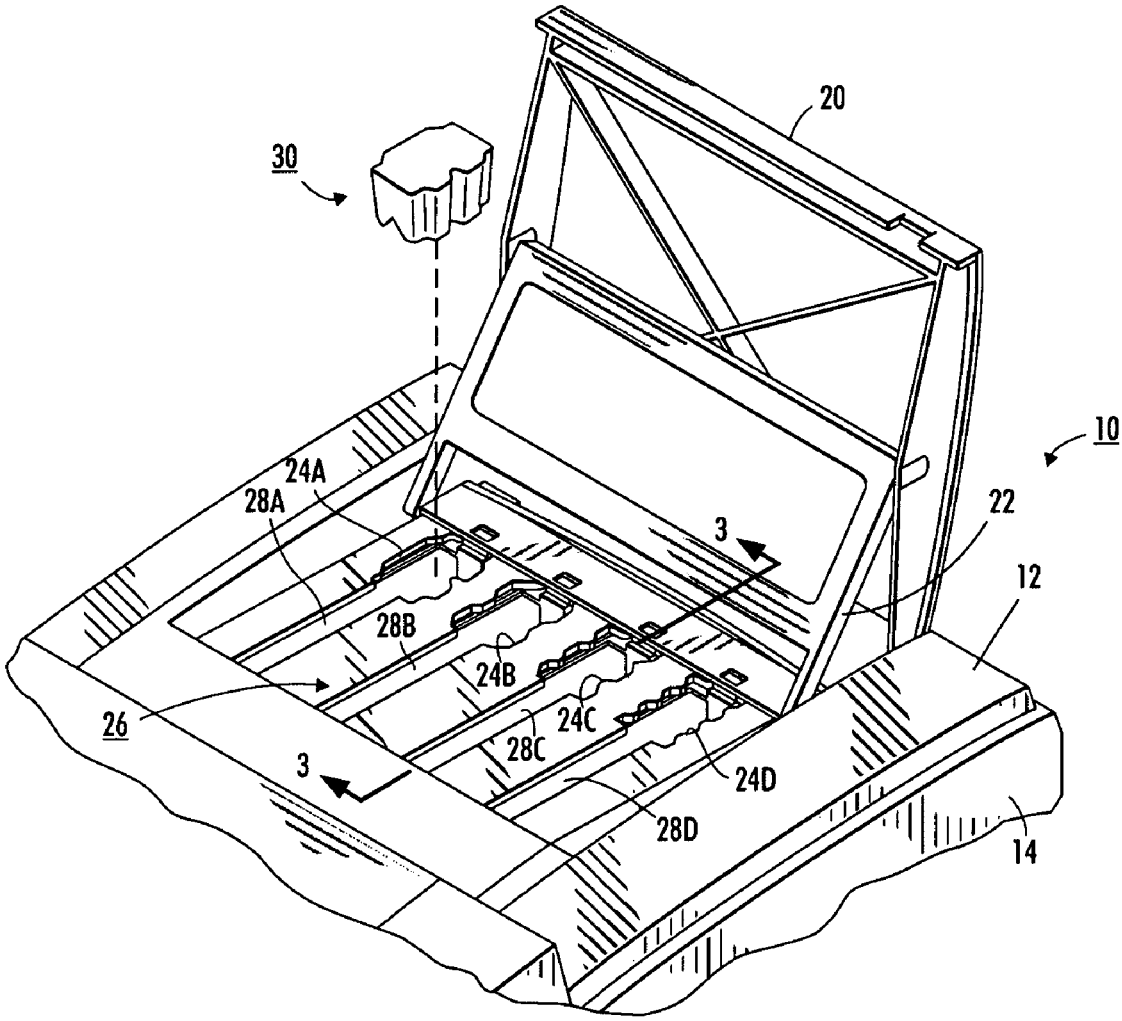
FIG. 2 PRIOR ART
FIG. 2 is an enlarged partial top perspective view of the phase change imaging device of FIG. 1 with the ink access cover open, showing a solid ink stick in position to be loaded into a feed channel.

In the particular printer shown in FIG. 2, the ink access cover 20 is attached to an ink load linkage element 22 so that when the printer ink access cover 20 is raised, the ink load linkage 22 slides and pivots to an ink load position. As seen in FIG. 2, opening the ink access cover reveals a key plate 26 having keyed openings 24A-D. Each keyed opening 24A, 24B, 24C, 24D provides access to an insertion end of one of several individual feed channels 28A, 28B, 28C, 28D of the solid ink feed system.

Figure 3:
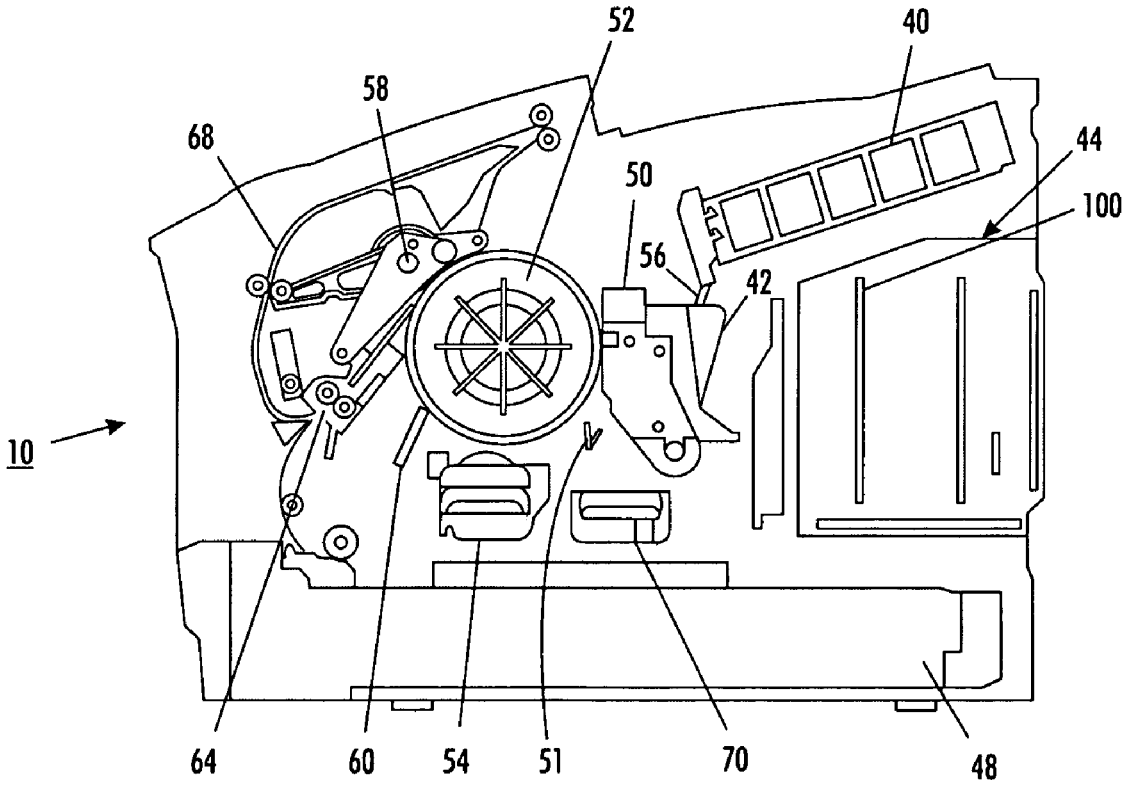
FIG. 3 is a side view of the imaging device shown in FIG. 1 depicting the major subsystems of the ink imaging device.

A color printer typically uses four colors of ink (yellow, cyan, magenta, and black). Ink sticks 30 of each color are delivered through one of the feed channels 28A-D having the appropriately keyed opening 24A-D that corresponds to the shape of the colored ink stick. The key plate 26 has keyed openings 24A, 24B, 24C, 24D to aid the printer user in ensuring that only ink sticks of the proper color are inserted into each feed channel. Each keyed opening 24A, 24B, 24C, 24D of the key plate has a unique shape. The ink sticks 30 of the color for that feed channel have a shape corresponding to the shape of the keyed opening. The keyed openings and corresponding ink stick shapes exclude from each ink feed channel ink sticks of all colors except the ink sticks of the proper color for that feed channel Referring now to FIG. 3, the printer 10 may include an ink loading subsystem 40, an electronics module 44, a paper/media tray 48, a print head assembly 50, a printhead wiper assembly 51, an intermediate imaging member 52, a drum maintenance subsystem 54, a transfer subsystem 58, a drum maintenance wiper subassembly 60, a paper/media preheater 64, a duplex print path 68, and an ink waste tray 70. Solid ink sticks 30 are loaded into ink loader feed path 40 through which they travel to a solid ink stick melting assembly 32. The solid ink sticks may be transported by gravity and/or urged by a drive member, such as, for example, a belt or spring, toward a melt plate in the melting assembly (not shown). At the melting assembly, the ink stick is melted and the liquid ink is delivered to one or more ink reservoirs 42 through a transport conduit 56 or simply through air as driven by gravity.

The print head assembly 50 receives liquid ink from the reservoir as needed for jetting onto a recording medium. The ink is ejected from the print head assembly 50 by piezoelectric elements through apertures (not shown) to form an image on the intermediate imaging member 52 as the member rotates. An intermediate imaging member heater is controlled by a controller 100 in the electronics module 44 to maintain the imaging member within an optimal temperature range for generating an ink image and transferring it to a sheet of recording media. A sheet of recording media is removed from the paper/media tray 48 and directed into the paper pre-heater 64 so the sheet of recording media is heated to a more optimal temperature for receiving the ink image. Recording media movement between the transfer roller in the transfer subsystem 58 and the intermediate image member 52 is coordinated for the fusing and transfer of the image. Please refer to U.S. Pat. No. 7,188,941, entitled "Valve for Printing Apparatus," U.S. Pat. No. 7,144,100 entitled "Purgeable Print Head Reservoir," and U.S. Pat. No. 7,121,658 entitled "Purgeable Print Head Reservoir," for description of exemplary embodiments of the print head assembly 50 and which are each hereby incorporated herein by reference in its entirety.

The print head assembly 50 may include a print head for each composite color. For example, a color printer may have one print head for emitting black ink, another print head for emitting yellow ink, another print head for emitting cyan ink, and another print head for emitting magenta ink. In this embodiment, ink sticks 30 of each color are delivered through separate feed channels to a melt plate. Consequently, each channel may have a melt plate, ink reservoir, and print head that is independent from the corresponding components for the other colors. Thus, each print head of the print head assembly may include a reservoir for holding ink for that print head. Other print head assembly configurations, however, are contemplated. For instance, the print head assembly may comprise one printhead that receives ink from a plurality of on-board ink reservoirs. In another embodiment, a single reservoir may supply ink to a plurality of print heads.

During operation of the print head, the meniscus of the melted ink is maintained at the nozzles of the print head assembly by providing a slightly negative pressure, or back pressure, to the melted ink inside the print head assembly 50. The slight negative pressure is configured to prevent melted ink from leaking or drooling out of the nozzles, and to ensure that the size of the ink droplets ejected from the nozzles remain substantially constant. The negative pressure is usually in the range of −0.5 to −5.0 inches of water. Any suitable method or device may be used to provide the slight negative pressure required to maintain the ink at the nozzles. For example, as is known in the art, the positioning of the ink reservoirs with respect to the print heads, the dimensioning of the conduits and passageways used to transport the ink may be selected to provide the requisite back pressure.

The various machine functions are regulated by a system controller 100 implemented in the electronics module 44. The controller 100 is preferably a programmable controller, such as a microprocessor, which controls the machine functions described. The controller also generates control signals that are delivered to the components and subsystems through the interface components. These control signals, for example, drive the piezoelectric elements to expel ink from the ink jet arrays in the print head assembly 50 to form an image on the imaging member 52 as the member rotates past the print head.

Figure 4:
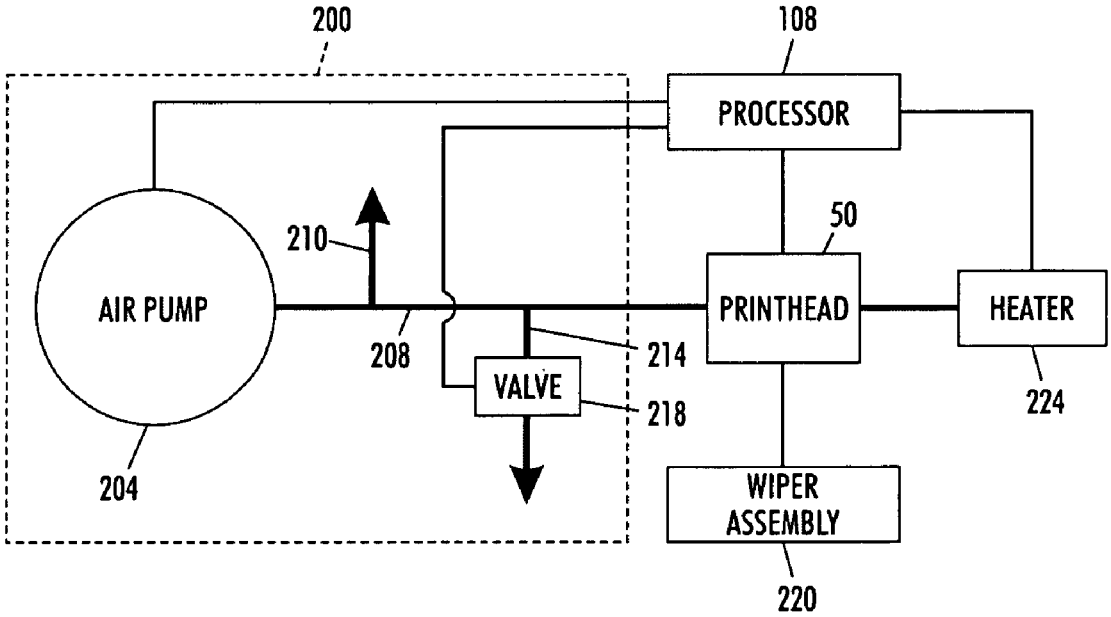
FIG. 4 is a schematic of a positive pressure purge system that can deliver at least two distinct pressures to the print head assembly of the imaging device.

As mentioned above, one difficulty faced by fluid ink jet systems is nozzle contamination. In order to prevent or recover from ink jet nozzle contamination, the printer 10 may include a maintenance system for periodically performing a maintenance procedure on the printhead assembly. Maintenance procedures typically include purging ink through nozzles of the print head, and wiping the nozzle plate to remove ink and debris from the surface of the nozzle plate. As depicted in the embodiment of FIG. 4, the maintenance system includes a purge system 200, and a wiping assembly 220. As explained below, the purge system 200 is designed to introduce a positive pressure into the one or more reservoirs 42 of the print head assembly 50 which pressurizes the ink in the channels and cavities of the print head assembly 50 high enough to cause the ink to be purged from the nozzles of the ink jets. The purged ink may be collected in a waste ink reservoir, such as, for example, a waste tray (70) or spittoon (not shown). The wiping assembly 220 includes at least one wiper blade (not shown) as is known in the art that is moved relative to the nozzle plate of the print head assembly 50 to remove ink residue, as well as any paper, dust or other debris that has collected on the nozzle plate. The wiping assembly 220 and/or the printhead assembly 50 may be configured to be moved with respect to each other into an operable position to perform the wiping procedure.

Ink may be purged through the orifices of the print head assembly 50 by introducing a positive purge pressure into the reservoirs 42 of the print head assembly 50 for a predetermined duration, or purge duration. Purge pressures are typically a few to several psi, and, in one embodiment, is approximately 4.1 psi. After purging, the nozzle plate of the print head assembly 50 may be wiped by the wiping assembly 220. To prevent ink from being pushed back into the print head 50 via the nozzles during wiping, the purge system 200 may also be configured to deliver a low pressure assist pressure to the print head assembly 50, which in an exemplary embodiment is about 0.04 psi, or about 1.1 to about 1.5 inches of water. Thus, the purge system 200 is configured to deliver air under pressure to the print head assembly at both the purge pressure and the assist pressure.

Referring to FIG. 4, the purge system 200 includes an air pump 204. The pump 204 in the exemplary embodiment is a rotary diaphragm air pump; however, any suitable type of air pump may be used. The pump 204 is in fluid communication with the print head assembly 50, and in particular, the reservoirs 42 (not shown in FIG. 4) of the print head assembly 50 via a passage 208. The passage 208 may be formed of any suitable material such as plastic tubing. The pump 204 runs at a predetermined rate that delivers a known pressure through the passage 208 because the diameter, length and other characteristics of the passage 208 are known. In the embodiment of FIG. 4, the pump 204 is configured to run at a rate that delivers a pressure through the passage 208 that is higher than the desired purge pressure of the print head.

The passage 208 includes two openings to control the pressure being delivered to the print head 50. A first opening 210 is provided to bleed off a portion of the fluid, which in the exemplary embodiment is air, flowing through the passage 208, which results in a lower pressure being delivered to the print head 50. The size of the first opening 210 is determined using methods that are known in the art so that a desired purge pressure can be delivered to the print head 50 when the pump is running at a known rate. By providing the first opening 210, a commercially available pump that delivers a constant pressure that is higher than the desired purge pressure may be used to deliver the purge pressure.

A second opening 214 is located downstream from the first opening 210. The second opening 214 allows fluid and/or pressure that was not bled off by the first opening 210 to bleed out of the second opening before traveling to the print head 50, thus the system may deliver a second pressure, or assist pressure, to the print head. The size of the second opening 214 is determined using methods that are known in the art so that a desired assist pressure can be delivered to the print head 50 when the pump is running at a known rate.

In the exemplary embodiment depicted in FIG. 4, the second opening 214 communicates with a valve 218 that selectively opens and closes the second opening 214. The valve 218 in the exemplary embodiment is a solenoid valve; however, other conventional valves may also be used. The valve 218 may be controlled by the controller in a known manner.

During a purge cycle, the controller 108 delivers a signal to the valve 218 to close the opening 214. The pressure delivered to the print head 50 then rises up to about 4.1 psi at 2.7 seconds. The controller 100, which may include a timer (not shown), opens the valve 218 at a predetermined time (e.g., at 2.7 seconds), and air bleeds off through the passage 214 quickly lowering the pressure delivered to the print head to about 1.3 inches of water. The controller 108 has been described as opening the valve 218 at a predetermined time. This was used in the exemplary embodiment because it was found to be the most inexpensive method for delivering two distinct pressures to the print head. In an alternative embodiment, the valve 218 may be configured to automatically open at a predetermined pressure and remain open until the next purge cycle.

The controller 108 may also control the amount of power supplied to the pump. In this alternative, the controller may allow for the delivery of a higher amount of power from the power source to the pump 204 during the purge cycle. Once the valve 218 is opened, the controller 100 may allow for the delivery of a lower amount of power to the pump. The lower amount of power, however, should be enough power to allow the pump to deliver a constant or near constant pressure. The pump 204 continues to run after the purge cycle and the second opening 214 bleeds off fluid to lower the pressure delivered to the print head 50 to the assist pressure.

Prior to operation of the printer, the printer goes through a warm-up procedure in which the transfer drum, the ink, the receiving media, and the print head assembly are heated from a lower ambient temperature, typically below the melting temperature of the phase change ink used in the printer up to a target operating temperature. As depicted in the embodiment of FIG. 4, the print head assembly may include a heater 224 for heating the print head assembly. As is known in the art, the controller 108 may control the temperature of the print head by controlling power to the heater 224 of the print head assembly 50. Heating the print head assembly melts the ink inside the print head and otherwise prepares the ink for flowing through the ink pathways of the print head assembly. The phase change ink used in the exemplary printer 10 may have melting points of 80° C. and higher. With many of these inks, optimal jetting may occur at significantly higher temperatures, such as 115° C. and above. Consequently, prior to printing, the print head may have to be heated to a temperature at or above these elevated jetting temperatures.

Tests have shown that phase change ink jet printers may be at risk for nozzle contamination during warm-up of the printer from a powered down, or standby, state to an operational state. For example, as the print head warms up from a temperature below the melting temperature of the phase change ink to a target operating temperature above the melting temperature of the ink, the solid ink that has solidified or frozen in the print head melts and expands in the print head, causing melted ink to drool out of the nozzles onto the nozzle plate. By the time the printer has warmed up sufficiently to perform printing operations, however, the ink that has drooled out of the nozzles onto the nozzle plate may be sucked back into the nozzles, potentially drawing contamination from the nozzle plate into the nozzles.

Figure 6:
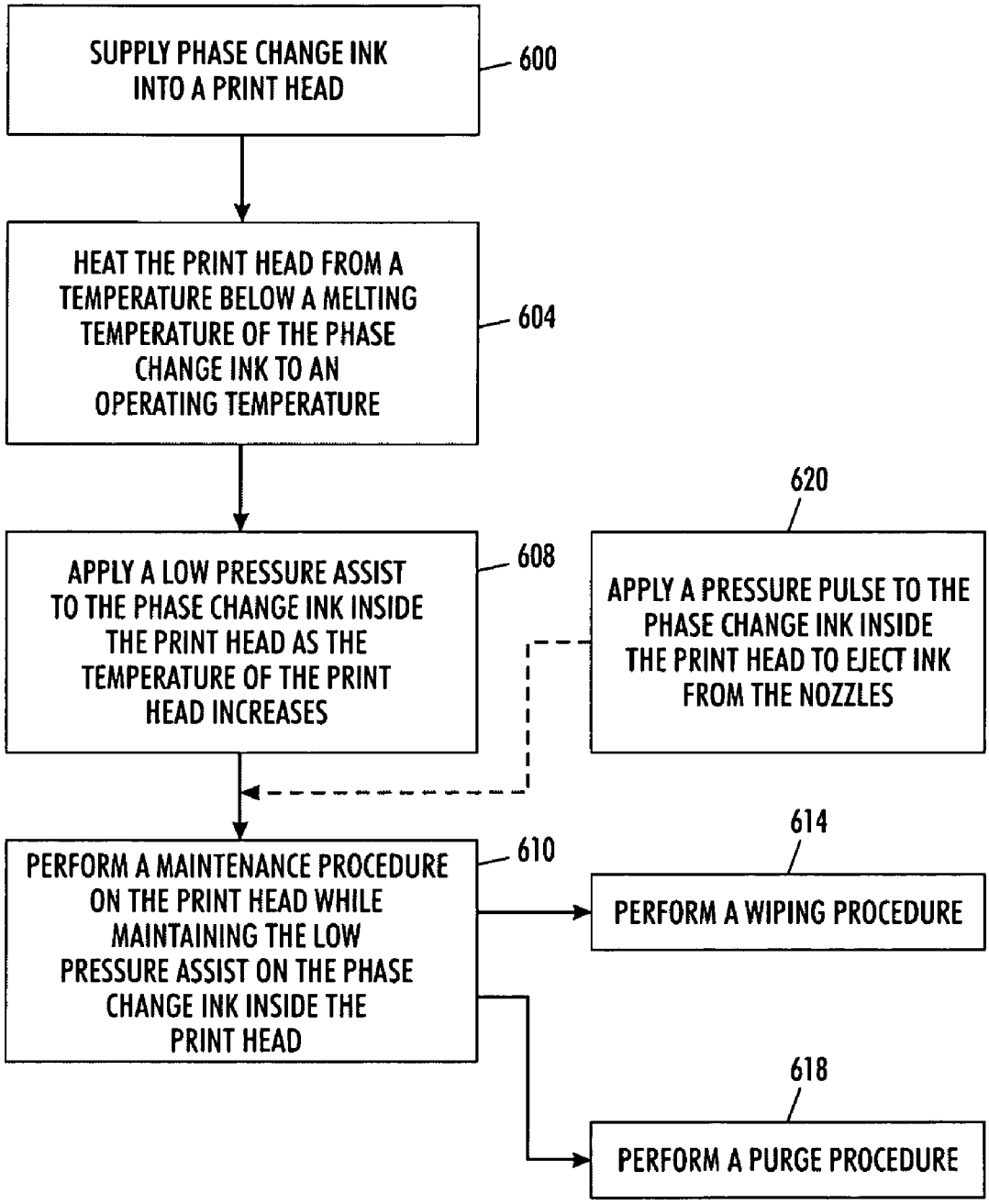
FIG. 6 is a flow chart of a method for preventing or reducing nozzle contamination during warm-up of the printer

Referring to FIG. 6, there is shown a flow chart of a method for preventing or reducing nozzle contamination during warm-up of the printer that includes the application of a low-pressure assist to the ink inside the print head during the warm-up of the print head assembly to prevent ink from being drawn back into the nozzles of the print head. The method includes supplying phase change ink into a print head (block 600). Ink may be supplied to the print head in a known manner, for example, by melting solid ink sticks and transporting the melted ink to the ink reservoirs of the print head assembly. The print head is heated from a first temperature below a melting temperature of the phase change ink to a second temperature above the melting temperature (block 604). The melting temperature may be approximately 80° C. although the exact melting temperature depends on the composition of the phase change ink material. The second temperature may be the operating temperature of the print head which may be, for example, approximately 115° C. and above. The second temperature, however, need not be the operating temperature. In some embodiments, the second temperature may be a standby temperature, for example, at which the ink is maintained in a liquid state within the print heads, but at a temperature below the optimum jetting temperature in order to minimize degradation of the ink that may be caused by excessive heat for prolonged periods of time.

As mentioned above, as the ink inside the print head assembly melts and expands, melted ink may drool out of the nozzles of the print heads and onto the nozzle plate. By the time the printer has warmed up sufficiently to perform printing operations, however, the ink that has drooled out of the nozzles onto the nozzle plate may be sucked back into the nozzles, potentially drawing contamination from the nozzle plate into the nozzles thereby contaminating the nozzles. In order to prevent the ink that has escaped the nozzles of the print head from reentering the print head during warm-up, a low pressure assist pressure is applied to the phase change ink inside the print head as the temperature of the print head increases from the first temperature to the second temperature (block 608). The low pressure assist pressure is greater than the back pressure that maintains the ink at the nozzles of the print head during operations. For example, in one embodiment, the low pressure assist pressure is between approximately 1.1 inches of water and 1.5 inches of water (or about 0.040 psi to about 0.054 psi) although the low pressure assist pressure may be any suitable pressure.

The low pressure assist may be applied as soon as the print heads begin to warm-up and may be applied for a predetermined duration. Durations for applying the low pressure assist during warm-up may be determined in any suitable manner and is within the capabilities of one of skill in the art. As an alternative, the low pressure assist pressure may be applied based on the temperature of the print head assembly. For example, the print head assembly may include one or more temperature sensors which may be used by the controller to determine the temperature of the print head assembly. In any event, the pressurization of the print head assembly may be ceased when the print head temperature reaches approximately the second temperature so that the back pressure in the print head assembly may stabilize the meniscus of the ink at the nozzles of the ink jets and to allow for normal printing operations to occur.

In one embodiment, after the temperature of the print head reaches approximately the second temperature and prior to removal of the first pressure, a maintenance procedure is performed on the print head assembly to remove phase change ink as well as any contamination from the nozzle plate (block 610). The maintenance procedure may comprise a wiping procedure (block 614) in which the nozzle plates of the print heads are wiped using a wiper blade of the wiper assembly. The low pressure assist pressure is maintained on the ink inside the printhead to prevent the ink from being pushed into the nozzles during the wiping procedure. After wiping the nozzle plate, the print head assembly may be purged by activating the purge system to apply the purge pressure to the phase change ink inside the print head for a purge duration (block 618). For example, to apply the purge pressure to the print head assembly 50, the controller 108 activates the air pump and delivers a signal to the valve 218 to close the opening 214. The pressure being delivered to the print head 50 then rises up to about 4.1 psi. The controller 108 deactivates the purge system at a predetermined time, or purge duration which may be, in one embodiment, approximately 2.7 seconds.

Figure 5A:
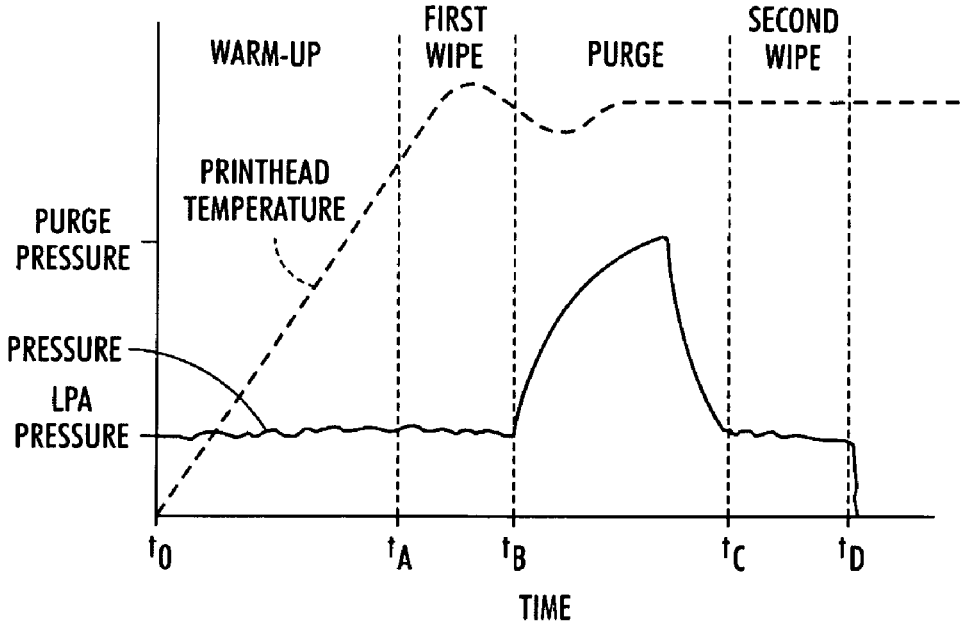
FIG. 5A is a graph of the pressure over time during one embodiment of a maintenance procedure that includes the application of a low pressure assist during warm-up.

FIG. 5A shows a graph that depicts the pressure applied to the printhead during a warm-up procedure that involves wiping the printhead before the purge procedure is performed. As can be seen, the pressure is at the low pressure assist level at $t_0$ when the printhead begins warming up (temperature indicated by dotted line). The pressure is maintained at the low pressure assist level during the warm-up phase ($t_0$-$t_A$) and the first wiping phase ($t_A$-$t_B$). As explained above, the low pressure assist prevents ink from being drawn into the printhead as the temperature of the printhead is increased to the operating temperature. In addition, the low pressure assist also helps to prevent ink from being pushed into the printhead by the wiping assembly during the wiping procedure. Once the first wiping phase is complete, the purge phase begins ($t_B$-$t_C$) in which the pressure on the printhead is increased from the low pressure assist pressure to the purge pressure for a predetermined duration at which point the pressure is returned to the low pressure assist pressure. At $t_C$, a second wiping procedure is performed to remove any ink or debris from the nozzle plate of the printhead that may result from the purge procedure. As can be seen, the pressure is returned to the low pressure assist pressure after the purge pressure is removed. The low pressure assist pressure is maintained on the printhead during the second wiping procedure to help prevent ink from being pushed into the printhead by the wiping assembly during the wiping procedure. Once the second wiping phase is complete, the low pressure assist pressure is removed from the printhead at $t_D$ at which point the printhead is warmed up and ready to perform print operations.

As an alternative to wiping the nozzle plate of the print head assembly while maintaining the low pressure assist pressure on the ink inside the print head assembly and subsequently purging the ink from the print head assembly, a purging procedure may be performed without wiping the nozzle plate of the print head assembly (block 618). For example, after the temperature of the print head reaches approximately the second temperature and prior to removal of the first positive pressure, the print head assembly may be purged, as described above by increasing the pressure on the phase change ink inside the print head from the low pressure assist to the purge pressure for the purge duration. After the purging is completed, the positive pressure is then removed from the ink inside the print head assembly so that the back pressure may stabilize the meniscus of the ink at the nozzles of the ink jets and to allow for normal printing operations to occur.

Figure 5B:
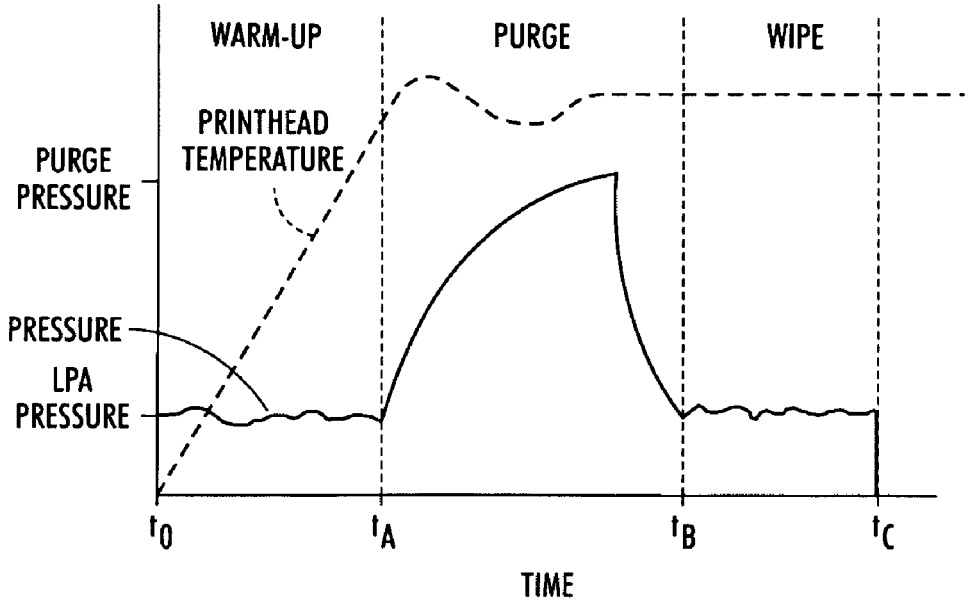
FIG. 5B is a graph of the pressure over time during another embodiment of a maintenance procedure that includes the application of a low pressure assist during warm-up.

FIG. 5B shows a graph that depicts the pressure applied to the printhead during a warm-up procedure in which the first wiping phase or procedure is eliminated. As can be seen, the pressure is at the low pressure assist level at $t_0$ when the printhead begins warming up (temperature indicated by dotted line). The pressure is maintained at the low pressure assist level during the warm-up phase ($t_0$-$t_A$). Once the warm-up phase is complete, the purge phase begins ($t_A$-$t_B$) in which the pressure on the printhead is increased from the low pressure assist pressure to the purge pressure for a predetermined duration at which point the pressure is returned to the low pressure assist pressure. At $t_B$, a wiping procedure is performed to remove any ink or debris from the nozzle plate of the printhead that may result from the purge procedure. As can be seen, the pressure is returned to the low pressure assist pressure after the purge pressure is removed. The low pressure assist pressure is maintained on the printhead during the wiping procedure to help prevent ink from being pushed into the printhead by the wiping assembly during the wiping procedure. Once the wiping phase is complete, the low pressure assist pressure is removed from the printhead at $t_C$ at which point the printhead is warmed up and ready to perform print operations.

In another embodiment, after the temperature of the print head reaches approximately the second temperature, at least one high pressure pulse may be applied to the print head in order to cause the emission of ink from the nozzles of the print head assembly (block 620). The ink that is emitted from the nozzles as a result of the high pressure pulse may flow along the surface of the nozzle plate, coalescing with ink that may have otherwise accumulated on the nozzle plate. The flow of ink along the nozzle plate may help dissolve dried ink and loosen dust or debris that has accumulated on the nozzle plate, thus, clearing the area around the nozzles of contamination. After the high pressure pulse(s) has been applied, the positive pressure applied to the printhead may be removed for a short duration to allow the clean ink around the nozzles to be drawn back into the printhead leaving any debris or contamination on the nozzle plate. A maintenance procedure, such as wiping and/or purging, may then performed on the print head assembly to remove the remaining debris or contamination from the nozzle plate. The high pressure pulse may have any suitable magnitude and/or duration that is capable of ejecting ink from the nozzles of the print head assembly. In one embodiment, the pressure pulse is applied at approximately the purge pressure for a duration that is less than the purge duration such as approximately 0.1 to approximately 1.5 seconds. Although the high pressure pulse may have any suitable magnitude of pressure and/or duration.

Figure 5C:
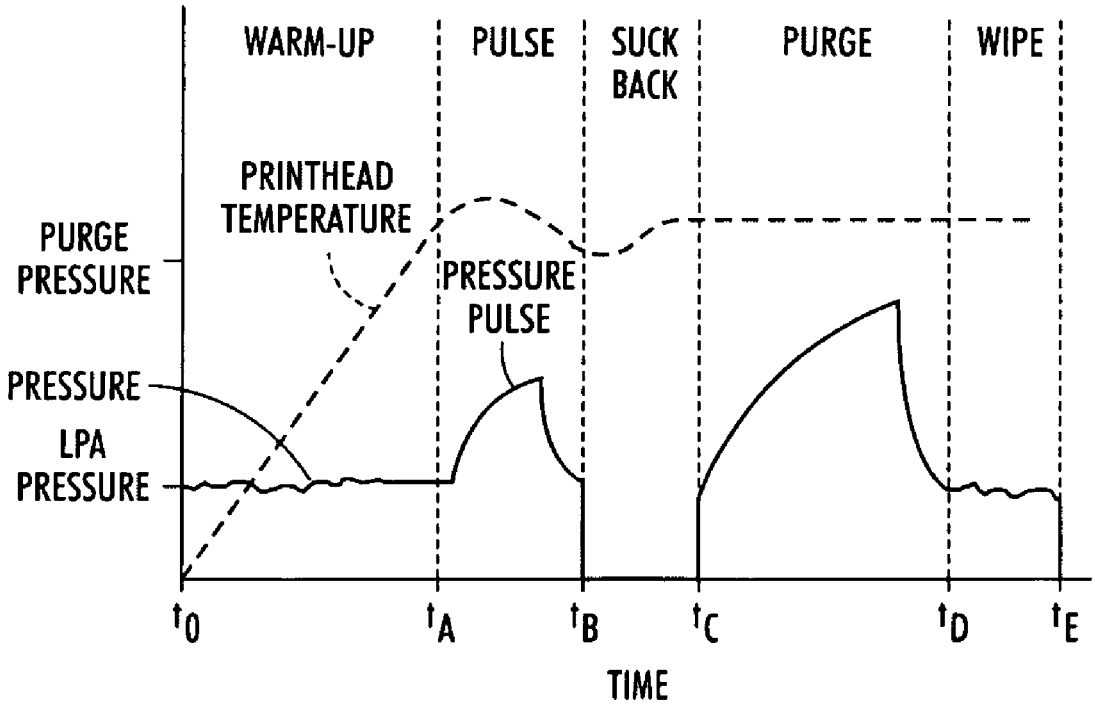
FIG. 5C is a graph of the pressure over time during another embodiment of a maintenance procedure that includes the application of a low pressure assist during warm-up.

FIG. 5C shows a graph that depicts the pressure applied to the printhead during a warm-up procedure that includes the high pressure pulse describe above. As can be seen, the pressure is at the low pressure assist level at $t_0$ when the printhead begins warming up (temperature indicated by dotted line). The pressure is maintained at the low pressure assist level during the warm-up phase ($t_0$-$t_A$). Once the warm-up phase is complete, a high pressure pulse is applied to the printhead at $t_A$ to cause the emission of ink from the nozzles of the print head assembly. After the pressure pulse is applied, the positive pressure is removed from the printhead at $t_B$ to allow the clean ink to be drawn back into the printhead. At $t_C$ the pressure is increased from the low pressure assist pressure to the purge pressure for a predetermined duration at which point the pressure is returned to the low pressure assist pressure. At $t_D$, a wiping procedure is performed to remove any ink or debris from the nozzle plate of the printhead that may result from the purge procedure. As can be seen, the low pressure assist pressure is maintained on the printhead during the wiping procedure. Once the wiping phase is complete, the low pressure assist pressure is removed from the printhead at $t_E$ at which point the printhead is warmed up and ready to perform print operations.

Those skilled in the art will recognize that numerous modifications can be made to the specific implementations of the melting chamber described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method of operating a print head, the method comprising:

heating a print head from a first temperature below a melting temperature of a phase change ink to a second temperature above the melting temperature, the print head having a nozzle plate with plurality of nozzles for ejecting the phase change ink onto an ink receiver;

applying a first pressure to an interior of the print head as the temperature of the print head increases from the first temperature to the second temperature, the first pressure configured to prevent phase change ink from entering into the print head through the nozzles of the print head; and removing the first pressure from the print head in response to the print head being at approximately the second temperature.

2. The method of claim 1, further comprising:

after the temperature of the print head reaches approximately the second temperature and prior to removal of the first pressure, performing a maintenance procedure on the print head to remove phase change ink from the nozzle plate while maintaining the first pressure on the interior of the print head.

3. The method of claim 2, the performance of the maintenance procedure further comprising:

wiping the nozzle plate of the print head to remove phase change ink from the nozzle plate while maintaining the first pressure on the interior of the print head.

4. The method of claim 3, further comprising:

after wiping the nozzle plate, purging the print head by applying a second pressure to the interior of the print head for a purge duration, the second positive pressure being greater than the first pressure and corresponding to a purge pressure.

5. The method of claim 2, the performance of the maintenance procedure further comprising:

purging the print head by increasing the pressure to the interior of the print head from the first pressure to a second pressure for a purge duration, the second pressure being greater than the first positive pressure and corresponding to a purge pressure.

6. The method of claim 1, further comprising:

after the temperature of the print head reaches approximately the second temperature, applying at least one pressure pulse to the print head assembly, the at least one pressure pulse being delivered at a pressure greater than the first positive pressure and a duration less than a purge duration, the at least one pressure pulse being configured to cause melted phase change ink to be emitted from the nozzles and to run down the nozzle plate.

7. The method of claim 6, the pressure of the at least one pressure pulse being at approximately a purge pressure.

8. The method of claim 6, the duration of the at least one pressure pulse being approximately 0.1 seconds to approximately 1.5 seconds.

9. The method of claim 1, the first pressure being between approximately 1.1 inches of water and approximately 1.5 inches of water.

10. The method of claim 1, the second temperature corresponding to an operating temperature of the print head.

11. A phase change ink imaging device comprising:

a print head including a nozzle plate with a plurality of nozzles for ejecting melted phase change ink onto an ink receiver;

a print head heater configured to heat the print head from a first temperature below a melting temperature of the phase change ink to a second temperature above the melting temperature;

a positive pressure source configured to apply a pressure to an interior of the print head at a first pressure and at a second pressure, the first pressure being configured to prevent phase change ink from entering the nozzles of the print head, the second pressure being greater than the first pressure and corresponding to a purge pressure; and a pressure controller configured to activate the positive pressure source to apply the first pressure to the interior of the print head as the temperature of the print head increases from the first temperature to the second temperature and to deactivate the positive pressure source so that the first pressure is removed from the phase change ink inside the print head when the temperature of the print head reaches approximately the second temperature.

12. The imaging device of claim 11, further comprising:

a maintenance system configured to perform a maintenance procedure on the print head to remove phase change ink from the nozzle plate, the controller being configured to activate the maintenance system after the temperature of the print head reaches approximately the second temperature to perform the maintenance procedure while maintaining the first positive pressure to the interior of the print head.

13. The imaging device of claim 12, the maintenance procedure comprising a wiping procedure.

14. The imaging device of claim 13, after the wiping procedure, the controller being configured to activate the positive pressure source after the temperature of the print head reaches approximately the second temperature to apply the second pressure to the interior of the print head for a purge duration, the second pressure being greater than the first pressure and corresponding to a purge pressure.

15. The imaging device of claim 12 , the controller being configured to activate the positive pressure source after the temperature of the print head reaches approximately the second temperature to apply at least one pressure pulse to the print head assembly, the at least one pressure pulse being delivered at a pressure greater than the first pressure and for a duration less than a purge duration, the at least one pressure pulse being configured to cause melted phase change ink to be emitted from the nozzles and to run down the nozzle plate.

16. The imaging device of claim 15, the pressure of the at least one pressure pulse being at approximately a purge pressure.

17. The imaging device of claim 15, the duration of the at least one pressure pulse being approximately 0.1 seconds to approximately 1.5 seconds.

18. The imaging device of claim 11, the controller being configured to activate the positive pressure source after the temperature of the print head reaches approximately the second temperature to increase the pressure to the interior of the print head from the first pressure to the second pressure for a purge duration, the second pressure being greater than the first pressure and corresponding to a purge pressure.

19. The imaging device of claim 11, the first pressure being between approximately 1.1 inches of water and approximately 1.5 inches of water.

20. The imaging device of claim 11, the second temperature corresponding to an operating temperature of the print head.

* * * * *